US009429008B2

(12) United States Patent
Beylotte

(10) Patent No.: US 9,429,008 B2
(45) Date of Patent: Aug. 30, 2016

(54) MEASURING TORQUE IN A DOWNHOLE ENVIRONMENT

(71) Applicant: SMITH INTERNATIONAL, INC., Houston, TX (US)

(72) Inventor: James E. Beylotte, Crosby, TX (US)

(73) Assignee: Smith International, Inc., Houston, TX (US)

( * ) Notice: Subject to any disclaimer, the term of this patent is extended or adjusted under 35 U.S.C. 154(b) by 259 days.

(21) Appl. No.: 14/198,854

(22) Filed: Mar. 6, 2014

(65) Prior Publication Data

US 2014/0262514 A1 Sep. 18, 2014

Related U.S. Application Data

(60) Provisional application No. 61/787,813, filed on Mar. 15, 2013.

(51) Int. Cl.
*E21B 45/00* (2006.01)
*E21B 44/00* (2006.01)

(52) U.S. Cl.
CPC ..... *E21B 44/00* (2013.01)

(58) Field of Classification Search
CPC ..... E21B 44/00; E21B 47/0006; E21B 44/04
See application file for complete search history.

(56) References Cited

U.S. PATENT DOCUMENTS 3,929,009 A 12/1975 Lutz et al.
4,848,144 A * 7/1989 Ho ..... E21B 7/04 175/45
5,465,799 A 11/1995 Ho
7,586,083 B2 9/2009 Vahabzadeh et al.
7,789,171 B2 9/2010 Grayson et al.
8,024,957 B2 * 9/2011 McKee ..... E21B 17/20 702/104
8,485,027 B2 7/2013 Payton
2005/0193811 A1 9/2005 Bilby et al.
2005/0279532 A1 12/2005 Ballantyne et al.
2009/0266609 A1 10/2009 Hall et al.
2010/0193246 A1 8/2010 Grayson et al.
2012/0123757 A1 5/2012 Ertas et al.
2012/0130693 A1 5/2012 Ertas et al.
2013/0049981 A1 * 2/2013 MacPherson ..... E21B 44/00 340/853.1
2013/0092439 A1 4/2013 Mauldin et al.
2013/0220701 A1 8/2013 Crowley et al.
2014/0262514 A1 * 9/2014 Beylotte ..... E21B 44/00 175/40
2014/0305702 A1 * 10/2014 Bowley ..... E21B 44/04 175/27

FOREIGN PATENT DOCUMENTS

WO WO2013112056 A1 8/2013

OTHER PUBLICATIONS

Magcanica Inc., "Core Torque Sensor", available at least by Mar. 17, 2012 at http://www.magcanica.com/torque.html, accessed via www.archive.org on Jan. 28, 2014, 2 pages.

* cited by examiner

*Primary Examiner* — Daniel P Stephenson

(57) ABSTRACT

A drilling system may include one or more downhole components to which a torque is applied. To determine the torque, the rotational velocity may be determined at two locations on a downhole component. An angle of twist may be determined by taking the integral of the rotational velocity at the two points, and the torque may be proportional to the angle of twist. The angle of twist, physical properties based on the geometry and material of the downhole component may be used, and the distance between the two locations may be used to calculate the torque.

20 Claims, 6 Drawing Sheets

MEASURING TORQUE IN A DOWNHOLE ENVIRONMENT

CROSS-REFERENCE TO RELATED APPLICATIONS

This application claims the benefit of, and priority to, U.S. Patent Application No. 61/787,813 filed Mar. 15, 2013 and entitled "MEASURING TORQUE IN A DOWNHOLE ENVIRONMENT," which application is hereby incorporated herein by this reference in its entirety.

BACKGROUND

Water and hydrocarbon-based resources (e.g., natural gas, crude oil, etc.) are some examples of resources that may be extracted from a subterranean rock formation. Accessing and then extracting such resources may often be made possible by drilling a well in the subterranean rock formation, and extending the well to the site where the natural resource is located. The location of the natural resources may often be very remote from a site of the well surface, and the well may sometimes extend many hundreds, if not thousands, of feet into the subterranean rock formation.

Drilling a well can be a complex and expensive task, and drilling a well in an efficient and cost-effective manner may include balancing a number of criteria. For instance, a well may be created by using a drilling system that includes a drill bit connected to a drill string. Power transmitted along the length of the drill string may be used to rotate the drill bit, and cut into the subterranean rock formation. As the drill bit continues to be used to drill deeper into the subterranean rock formation, the drill bit experiences wear. With increased wear, the drill bit becomes less effective and efficient at drilling into the rock formation. As a result, the rate of penetration of the drilling system may decrease. More power may potentially be supplied to increase the rate of penetration; however, increasing the power also adds cost and can potentially cause the drill bit to wear at an even faster rate. Eventually, the drill bit may be removed from the well and replaced by a new drill bit before continuing to extend a well. Removing and replacing a drill bit adds additional expense by virtue of equipment and power costs, and further increases the time, and thus expense, needed to complete a well. Of course, other factors, including conditions within the well (e.g., fluids, cuttings, etc.) may also affect the efficiency of a drilling system.

Further complicating a determination of how to effectively drill a well, conditions of a well may continually evolve. For instance, the material properties of the subterranean rock formation may change. Further, well geometry and length may affect drilling efficiency. For instance, power may increasingly be lost due to friction, heat, or other causes if the well constricts or turns, or even as the length increases. Continual changes to the drill speed, rate of penetration, weight on bit, supplied power, cutting fluids, and other factors associated with drilling a well may therefore be provided to react to ever-changing conditions.

In addition to the complexities in balancing multiple considerations, reacting to the changing conditions may also be difficult if the conditions themselves are not known. It may be difficult, for instance, to use some sensors within a well simply due to the conditions within the well itself. For instance, the drilling system may experience high vibrational and accelerating forces capable of damaging the sensors. Further, a well may be filled with materials such as cutting fluids, rock cuttings, hydrocarbon fluids, and the like.

These materials may be abrasive and can damage the sensors within the well. The harsh conditions may exceed allowable conditions for reliable or prolonged use of some types of sensors. A damaged sensor may provide unreliable results, or no results, thereby making it difficult to accurately understand well conditions. Without a good understanding of conditions within the well, it may also be difficult to balance the considerations needed to most efficiently drill the well.

As a more particular example, power or torque may be measured on a drilling component within the well. Strain gauges are commonly used to measure torque, and use wires attached to a surface where strain is to be measured. To provide an accurate measurement, the wires must be reliably connected, and remain reliably connected, which can be difficult in the harsh conditions within a well. Additionally, the drilling component should have a sufficiently large cross-sectional shape to accommodate large loads. The large cross-sectional shape may, however, make it more difficult for the strain gauge to measure small loads. Adding environmental protection may be used in some cases to protect the strain gauge from the harsh well environment on the exterior of a drilling component, but adds to the size and expense of the strain gauge. Moreover, even when environmentally protected, strain gauges are used after a lengthy calibration process, and even then begin to drift over time unless recalibrated.

SUMMARY OF THE DISCLOSURE

Assemblies, systems and methods of the present disclosure may relate to calculating properties of a downhole component within a wellbore. In one example embodiment, properties that are calculated may include an angle of twist of a downhole component, a torque on the downhole component, or mechanical power transmitted through the downhole component.

According to one embodiment of the present disclosure, a method for determining torque on a downhole component within a wellbore may include obtaining rotational velocity measurements of one or more downhole components within a wellbore. Two or more rotational velocities may be obtained at different locations. From the rotational velocities, the torque on a downhole component may be approximated, derived, or calculated.

An example drilling system may include a downhole component and at least two sensing instruments coupled thereto. The sensing instruments may include, or be coupled to, sensors used to measure rotational velocity. A controller may communicate with the sensing instruments and obtain the measurements of rotational velocity. From the measurements of rotational velocity, torque at a location adjacent, or between, the sensing instruments, may be calculated.

An illustrative method of the present disclosure may be used for calculating torque on a downhole tool within a wellbore. In the method, synchronized measurements may be obtained. The measurements may include rotational velocities at first and second locations of the downhole tool. The synchronized measurements may be integrated and a difference between the integrals may be determined. The torque may be calculated using a distance between the first and second locations, the difference between the integrals, and physical properties of the downhole tool.

In accordance with at least some embodiments of the present disclosure, calculating torque may include determining an angle of twist between two points. The angle of twist may be determined by integrating the rotational velocity at two points a given distance apart. The angle of twist may be used with the distance between the two points, and with the physical properties of the downhole component, to calculate instantaneous torque on the downhole component. Power (e.g., mechanical power) transmitted through the downhole component may be calculated using rotational velocity measurements along with torque.

This summary is provided solely to introduce some features and concepts that are further developed in the detailed description. Other features and aspects of the present disclosure will become apparent to those persons having ordinary skill in the art through consideration of the ensuing description, the accompanying drawings, and the appended claims. This summary is therefore not intended to identify key or essential features of the claimed subject matter, nor is it intended to be used as an aid in limiting the scope of the claims.

BRIEF DESCRIPTION OF DRAWINGS

In order to describe various features and concepts of the present disclosure, a more particular description of certain subject matter will be rendered by reference to specific embodiments which are illustrated in the appended drawings. Understanding that these drawings depict illustrative embodiments and are not to be considered to be limiting in scope, nor drawn to scale for each embodiment contemplated as within the scope of the claims or description, various embodiments will be described and explained with additional specificity and detail through the use of the accompanying drawings in which:

DETAILED DESCRIPTION

In accordance with some aspects of the present disclosure, embodiments herein relate to systems and assemblies for measuring one or more properties within a wellbore. More particularly, embodiments disclosed herein may relate to systems, assemblies, devices, and methods for measuring properties on a drill string component within a wellbore. Example properties of the drill string component may include the torque on a drill string component, the angle of twist along a length of a drill string component, other properties, or some combination thereof. Further embodiments may also relate to determining the angle of twist and/or the instantaneous torque on a drill string component by measuring rotational velocity at two locations. The angle of twist may be determined by taking the integral of the difference of the rotational velocity measurements at the two locations. The torque may be proportional to the angle of twist and calculated by using the angle of twist, the distance between the two rotational velocity measurements, or other material properties of the drill string components.

Figure 1:
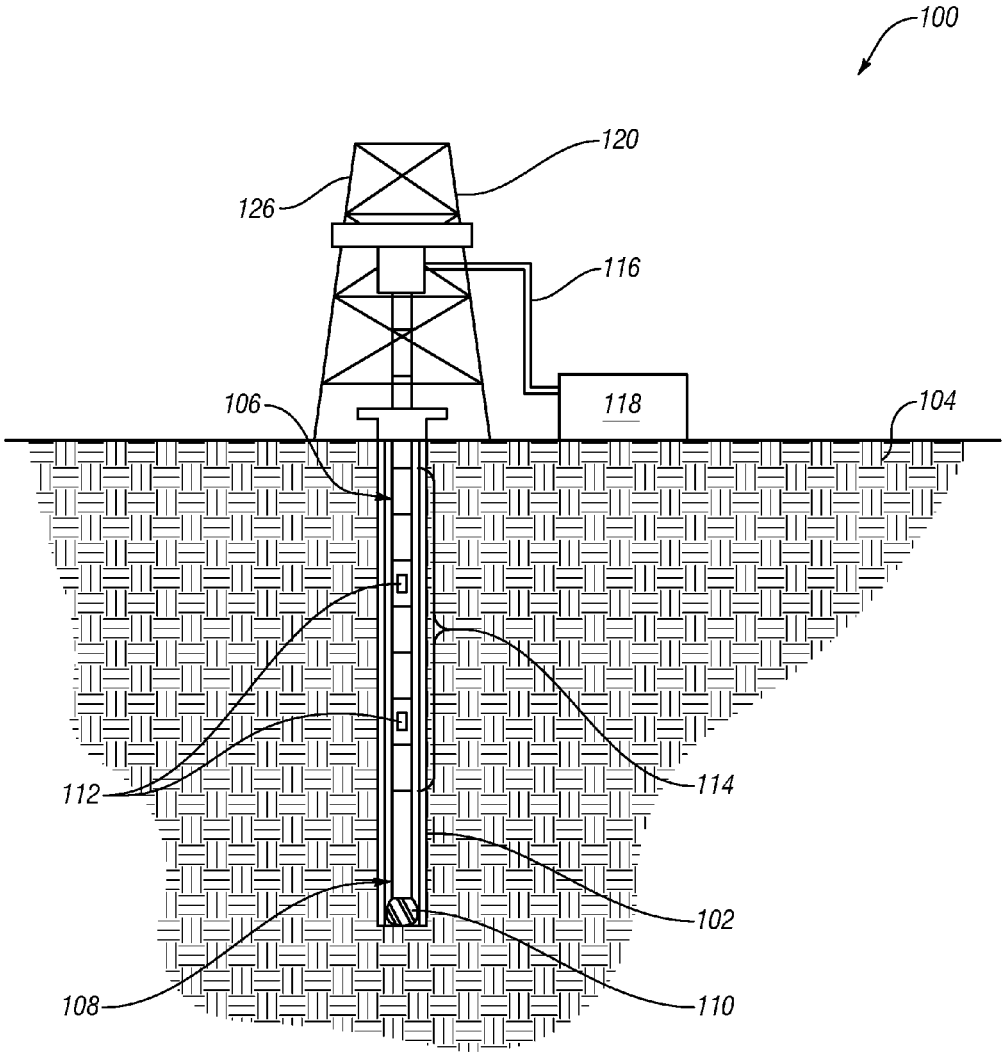
FIG. 1 illustrates an example environment in which a wellbore may be drilled in a subterranean rock formation, and in which torque on one or more drill string components may be measured according to one embodiment of the present disclosure.

Referring now to FIG. 1, a schematic diagram is provided of an example drilling system 100 that may utilize systems, methods, assemblies, and devices of embodiments of the present disclosure to measure properties within a wellbore 102. The wellbore 102 may be a cased wellbore, as shown in FIG. 1; however, in other embodiments, the wellbore 102 may be uncased and may be an openhole wellbore. In other embodiments, the wellbore 102 may include both cased and openhole portions.

In one example, the drilling system 100 may be used to measure properties in or around the wellbore 102. Measuring properties in or around the wellbore 102 may include measuring information about the wellbore 102 itself (e.g., width, depth, etc.). In other embodiments, measuring properties of the wellbore 102 may include measuring properties of the subterranean rock formation 104 in which the wellbore 102 is formed.

According to some embodiments of the present disclosure, a drill string 106 may be located within the wellbore 102. The drill string 106 may include a tubular member (e.g., drill pipe, coiled tubing, etc.), and may potentially be coupled to other components (e.g., a bottom-hole assembly 108, a drill bit 110, jars, vibration tools, bumper subs, circulation subs, cementing tools, reamers, underreamers, motors, stabilizers, wellbore departure tools, etc.). Measuring properties in or around the wellbore 102 may also include measuring or determining properties of the drill string 106, bottom-hole assembly 108, drill bit 110, or other component wholly or partially within the wellbore 102.

In the particular embodiment illustrated in FIG. 1, a set of one or more sensing instruments 112 may be placed within the wellbore 102 in order to measure a desired property within the wellbore 102. In at least one embodiment, the sensing instruments 112 may include sensors for measuring information about the drill string 106 or a component coupled thereto. For instance, the sensing instruments 112 may measure information such as torque using one or more strain gauges or other components or systems. In another embodiment, the sensing instruments 112 may include one or more positional sensors. For instance, each sensor of the sensing instruments 112 may measure a rotational position relative to another sensing instrument 112. Such position may then be used to determine an angle of twist between two sensing instruments 112 as discussed in more detail herein.

In another embodiment, and as described in greater detail herein, the sensing instruments 112 may include one or more sensors to measure rotational velocity. Such a sensor may measure the rotational velocity at a particular location in any suitable units (e.g., revolutions per minute, radians per second, etc.). From the rotational velocity, the drilling system 100 may calculate an angle of twist and/or a torque along a portion of the drill string 106 or other component coupled thereto (e.g., bottomhole assembly 108, drill bit 110, etc.). A sensor or other sensing instrument 112 used to measure rotational velocity may be located at virtually any depth within the wellbore 102, and can be positioned on an exterior or interior of any drilling component (e.g., drill string 106, bottom-hole assembly 108, drill bit 110, a mud motor, a turbine, a reamer, a stabilizer, etc.).

In some embodiments, the sensing instruments 112 optionally include so-called logging while drilling ("LWD") and/or measurement-while-drilling ("MWD") instruments. Such instruments may make measurements while drilling the wellbore 102 using the drill bit 110, and may potentially log such information. Information logged using the sensing instruments 112 may be stored locally on the drill string 112, conveyed to the surface (e.g., using mud pulse telemetry, wired drill pipe, fiber optics in coiled tubing, or in another manner). It should be appreciated by a person having ordinary skill in the art, in view of the disclosure herein, that the sensing instruments 112 should not be limited to LWD and MWD components, and in other embodiments may include components not conventionally associated with LWD or MWD systems.

In an example embodiment, including that illustrated in FIG. 1, the drill string 106 may be comprised of multiple segments 114 of wired drill pipe. The wired drill pipe segments 114 may be physically and electronically coupled so that information obtained by a sensing instrument 112 may be conveyed along the drill string 106 and to the surface. In another example embodiment, the drill string 106 may include coiled tubing. The coiled tubing may include communication capabilities therein (e.g., wire, fiber optics, etc.). The communication capabilities of the coiled tubing may be communicatively linked to the one or more sensing instruments 112 on the coiled tubing or a downhole tool coupled to the downhole tool, thereby allowing information obtained by the sensing instruments 112 to be conveyed along the drill string 106 to the surface.

Measurements or other information obtained in the wellbore 102 may be communicated over a communication line 116 to a controller 118. The controller 118 may store the received data and/or further processes the received data. In other embodiments, the sensing instruments 112 may communicate with each other and/or process obtained measurement or other data within the wellbore 102.

The controller 118 may be remote or local relative to the wellbore 102. In the illustrated embodiment, for instance, the controller 118 may include a command or operations center located adjacent a rig 120 used to trip the drill string 106 into the wellbore 102 and/or to rotate the drill string 106, bottom-hole assembly 108, or drill bit 110. The controller 118 may be fixed or mobile in nature. Regardless of the particular structure, however, the controller 118 may include, or communicate with, a computing system or data store to receive, store, process, or otherwise use data received from the sensing instruments 112.

The illustrated environment and drilling system 100 is merely illustrative of one example embodiment of a system in which embodiments of the present disclosure may be used. In other embodiments, the drilling system 100 may use a land-based system similar to that of FIG. 1, but include additional or other components. For instance, the drill string 106 is illustrated as including a tubular member comprised of multiple wired drills string segments 114. In other embodiments, however, the drill string may include other components, including jointed tubing that is not wired for electrical communication. In still other embodiments, the drill string may include coiled tubing, as discussed herein.

Furthermore, the drill string 106 may include any number of different components or structures, including a motor. Example motors may include positive displacement motors, mud motors, electrical motors, turbines, or some other motor designed to rotate the drill string 106, the bottom-hole assembly 108, the drill bit 110, other downhole components, or some combination of the foregoing. The drill string 106 may also include directional drilling equipment. As an example, the bottom-hole assembly 108 may include a steerable drilling assembly to control the direction of drilling, to potentially allow drilling of a lateral or deviated wellbore within the subterranean rock formation 104. A steerable drilling assembly may include various types of directional control systems, including rotary steerable systems referred to as push-the-bit or point-the-bit systems, or any other type of rotary steerable or directional control system. In other embodiments, wellbore departure or conveyance tools (e.g., whipstocks, mills, tractors, etc.) may be coupled to the drill string 106 and used to allow drilling of a lateral or deviated wellbore.

Figure 2:
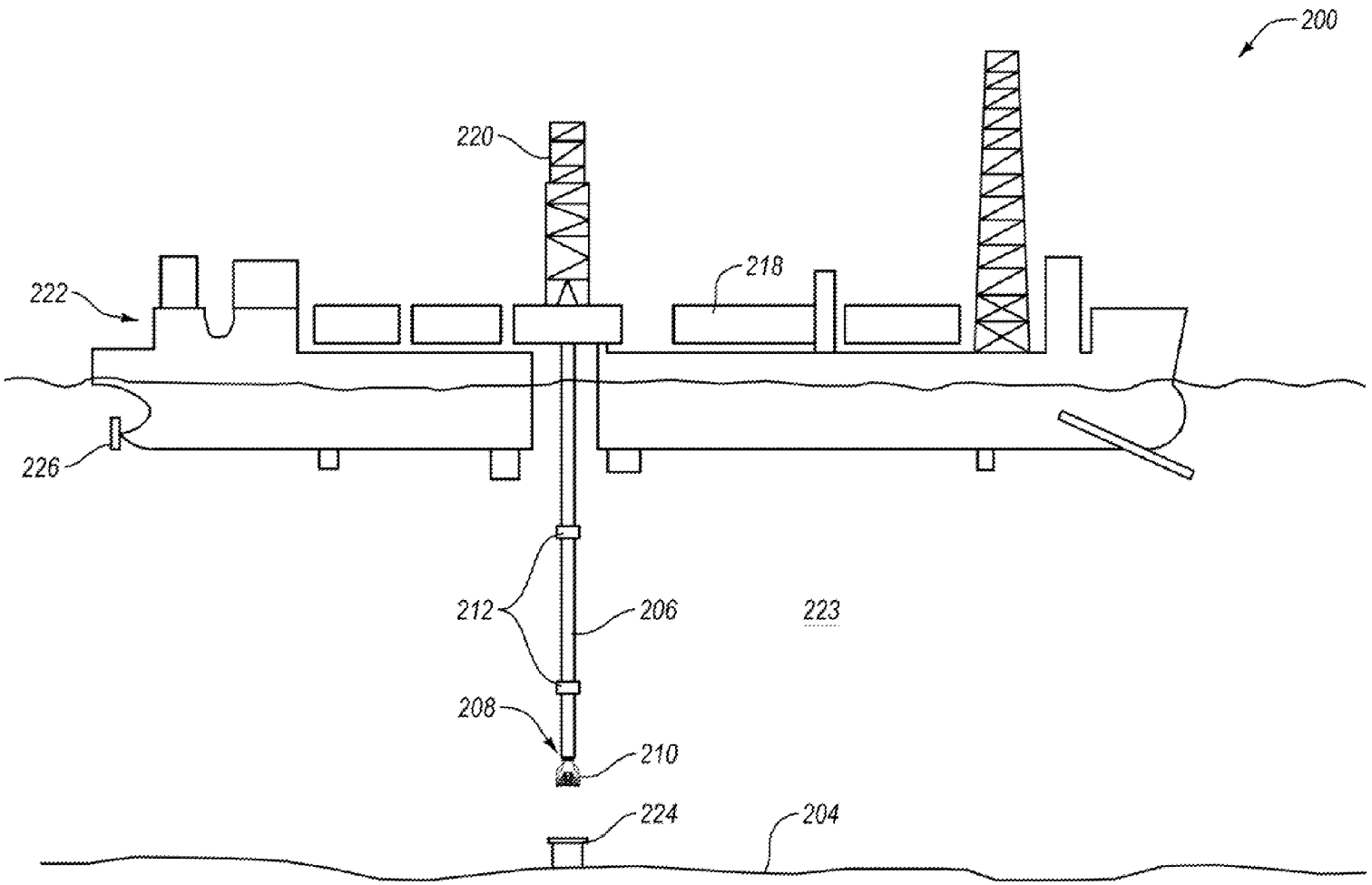
FIG. 2 illustrates an example of an additional environment in which a subsea wellbore may be drilled into a rock formation, and in which torque on one or more drill string components may be measured according to another embodiment of the present disclosure.

While the rig 126 is illustrated as a land rig, the drilling system 100 may in other embodiments use other types of rigs or systems, including an offshore rig. FIG. 2, for instance, illustrates an additional embodiment of a drilling system 200, in which an offshore rig 220 is used to trip a drill string 206 within a subsea wellbore to drill the wellbore within a subterranean rock formation 204. The offshore rig 220 may be stationary or movable, although FIG. 2 illustrates a movable offshore rig 220.

The drilling system 200 of FIG. 2 may include a surface vessel 222 positioned on the surface of a body of water 223, and generally over a wellhead 224. The wellhead 224 may be located on or near a sea floor of the subterranean rock surface 202, and can provide access to the wellbore. To position the surface vessel 222 at a desired location relative to the wellhead 224, the surface vessel 222 may include a propulsion system 226. Example propulsion systems 226 may include components such as a thrusters or propellers, or other components which can maintain the surface vessel 222 at a desired position.

The surface vessel 222 may also be suitable for multiple uses, and to provide multiple drilling-related functions. For instance, rig 220 may trip a drill string 206 that has one or more sensing instruments 212 thereon. As discussed herein, the sensing instruments 212 may be used to measure, calculate, store, or otherwise provide any number of types of information. By way of illustration, the sensing instruments 212 may be used to calculate rotational velocity at one or more locations on the drill string 206, bottom-hole assembly 208, drill bit 210, other component, or some combination thereof. The sensing instruments 212 may also process the information (e.g., to obtain angle of twist or torque data), store the data, communicate the information to another component, or the like. In some embodiments, for instance, the sensing instruments 212 may communicate obtained data using a wired or wireless communication link. In at least some embodiments, a controller 218 may be communicatively coupled to the sensing instruments 212. Thus, measurements or data sensed or otherwise obtained by the sensing instruments 212 may be communicated to the controller 218 for further processing, storage, or communication.

It should be appreciated in view of the disclosure herein that the drilling system 200 of FIG. 2 may be similar in many regards to the drilling system 100, other than with respect to the location of the wellbore and the rig 220. Accordingly, the disclosure herein should be understood to apply equally to multiple types of wells and drilling systems, regardless of the particular location or type of well or equipment used. Indeed, turning now to FIGS. 3 and 4, an example wellbore 302 formed in a subterranean rock formation 304 may be associated with a land-based drilling system or a subsea or offshore drilling system.

Figure 3:
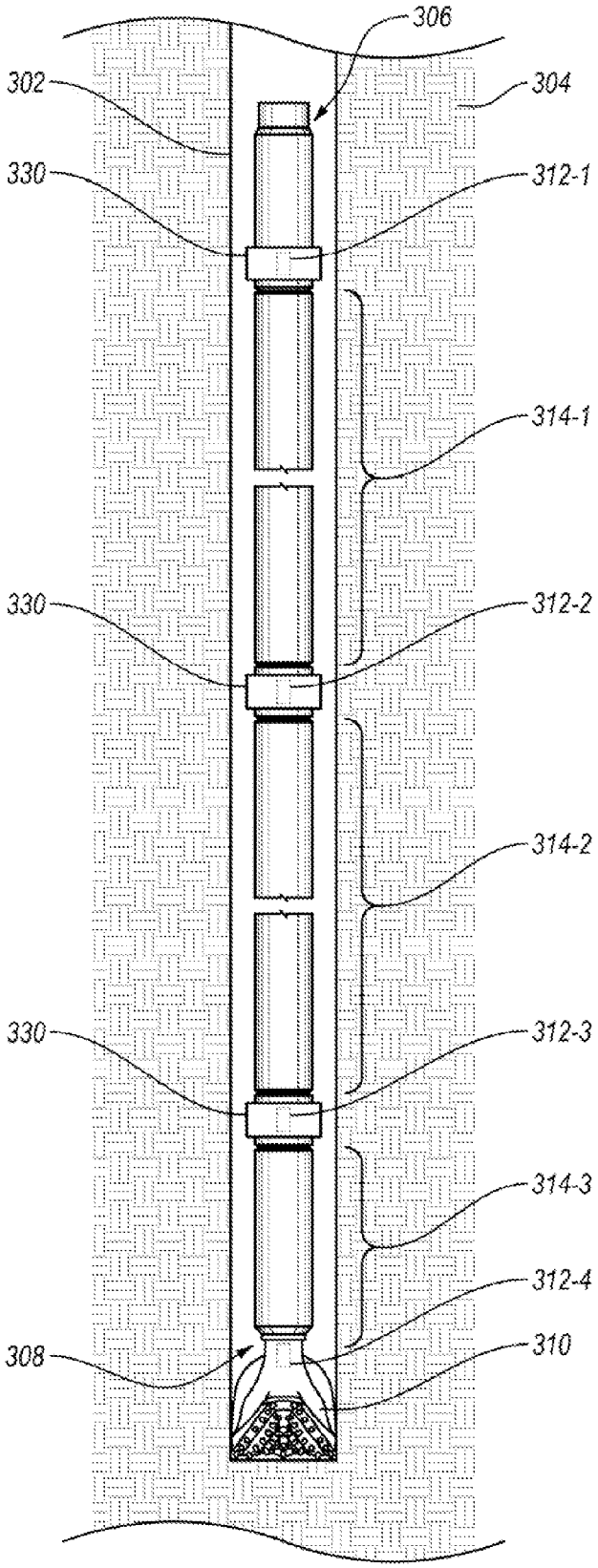
FIG. 3 illustrates a partial cross-sectional view of an example drill string within a wellbore, according to one embodiment of the present disclosure.
Figure 4:
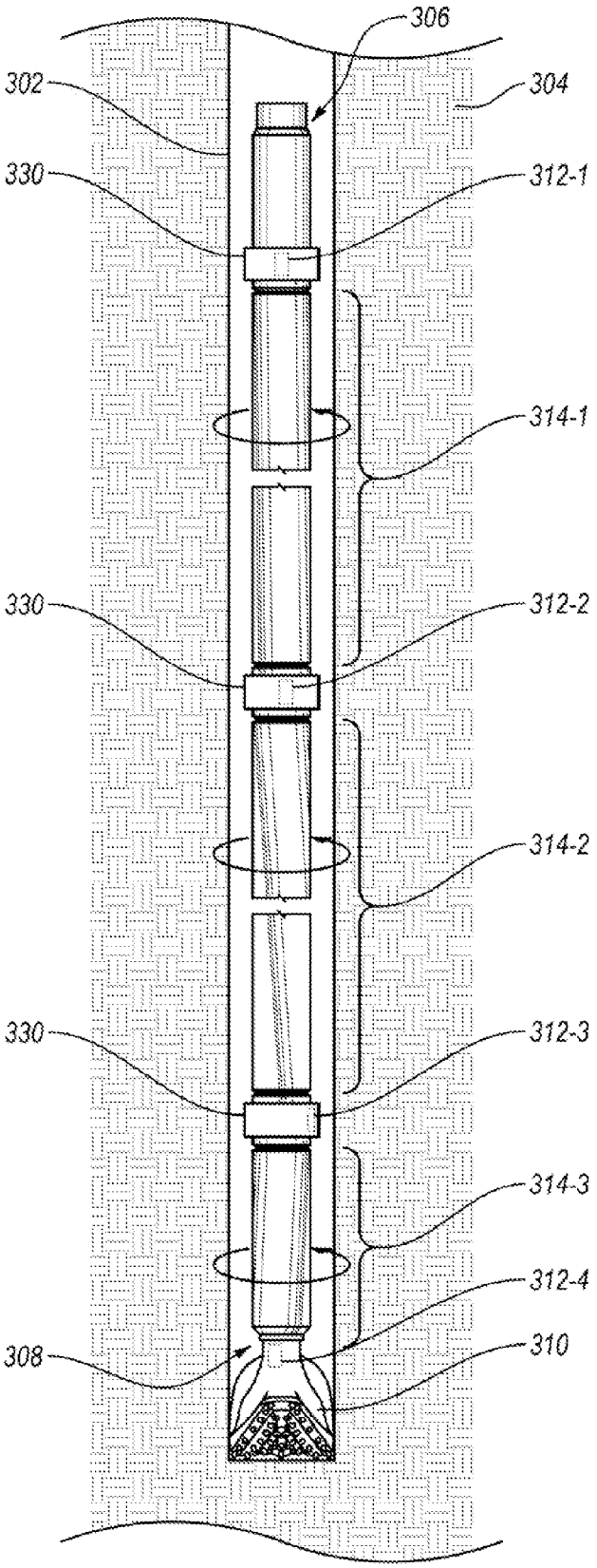
FIG. 4 illustrates a partial cross-sectional view of another example drill string within a wellbore, the drill string being rotated with different sections experiencing different amounts of torque, according to another embodiment of the present disclosure.

FIGS. 3 and 4 illustrate an example embodiment of a drill string 306 that may be used to drill a wellbore 302 in the rock formation 304. To drill the wellbore 302, the drill string 306 may be tripped into the wellbore 302. A drill bit 310 may be coupled to the drill string 306. When the drill bit 310 is rotated, the drill bit 310 may cut into the subterranean rock formation 304 and lengthen the wellbore 302. Optionally, the drill bit 310 may rotate at a rate that is different than a rotational rate of the drill string 306. In some embodiments a portion of the drill string 306 may not rotate, although in other embodiments a full length of the drill string 306 may rotate. Accordingly, in various embodiments, the drill bit 310 and drill string 306 may rotate at the same or different rotational velocities.

When a rotational force is applied to the drill string 306, bottom-hole assembly 308, or the drill bit 310, each rotating portion may experience torque. The drill string 306 may also have disposed thereon, or otherwise coupled thereto, multiple sensing instruments 312-1, 312-2, 312-3, 312-4, as shown in FIGS. 3 and 4. Optionally, the sensing instruments 312-1, 312-2, 312-3, 312-4 may include rotational velocity sensors (e.g., RPM sensors), which can provide information about the rotational velocity at a particular location along the drill string 306, bottom-hole assembly, 308, or drill bit 310. These sensing instruments 312-1, 312-2, 312-3, 312-4 may optionally include other sensors or instruments. For instance, strain gauges or other instruments used to measure torque may be included where such information may be desirable. In accordance with embodiments of the present disclosure, however, strain gauges or other torque sensors may optionally be omitted, and rotational velocity sensors may instead be used to calculate or approximate torque on a given section of the drill string 306, bottom-hole assembly 308, or drill bit 310. Torque may thus be determined in some embodiments by using instruments used for obtaining other measurements, and few, if any, additional components may be used to measure torque. The drill string 306 may therefore have fewer components and reduced cost.

As shown in FIGS. 3 and 4, the sensing instruments 312-1, 312-2, 312-3, 312-4 may each be separated by a length of the drill string 306. The amount of separation between the sensing instruments 312-1, 312-2, 312-3, 312-4 may be generally the same or may be different. In particular, two sensing instruments (e.g., sensing instruments 312-1, 312-2) may be separated by a first length, while other sensing instruments (e.g., sensing instruments 312-3, 312-4) may be separated by a second length. The first and second lengths may be about the same, or may be different.

Figure 5:
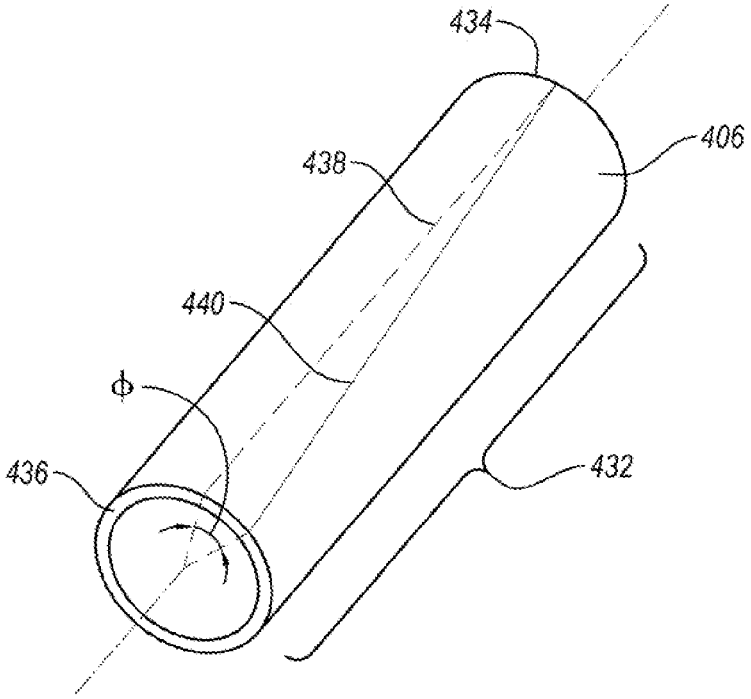
FIG. 5 schematically illustrates a drill string component and an angle of twist thereof when a torque is applied to the drill string component, according to one embodiment of the present disclosure.

In some embodiments, the lengths of the drill string 306 between corresponding sensing instruments 312-1, 312-2, 312-3, 312-4 may be sufficient to allow for an amount of twist to be determined. More particularly, when the drill string 306 rotates, not all components may rotate concurrently. For instance, a restriction in the wellbore may restrict a portion of the drill string 306 from rotating. If the rate of rotation of one portion of the drill string is higher relative to another portion, the drill string 306 may twist. For instance, FIG. 5 schematically illustrates an example of a section of drill string 406 having a length 432, and opposing first and second ends 434, 436 which may rotate at different velocities. If the first and second ends 434, 436 were to rotate at the same velocity, the same points would align each after each rotation. For instance, in FIG. 5, following each rotation, the same points at the first and second ends 434, 436 could align along the line 438. The line 438 may extend axially along the section of the drill string 406 and about parallel to the longitudinal axis of the section of the drill string 406.

Where there are different rotational velocities at the first and second ends 434, 436, however, points at the first and second ends 434, 436 may become misaligned due to twisting of the drill string 406. For instance, if the second end 436 rotates clockwise at a greater speed than the first end 434, the same points that would otherwise be in alignment along line 438 may instead be aligned along a line 440 which is angled relative to line 438 and the longitudinal axis of the section of the drill string 406. The angle between the lines 438, 440 may be referred to as the angle of twist ($\phi$). In general, the angle of twist, $\phi$, may be represent the difference in position at the first and second ends 434, 436 after a full rotation, over the length 432.

Returning now to FIGS. 3 and 4, the drill string 306 may rotate, thereby causing different sections 314-1, 314-2, 314-3 of the drill string 306 to rotate. In general, the illustrated sections 314-1, 314-2, 314-3 of the drill string 306 are shown as being positioned between different sensing instruments 312-1, 312-2, 312-3, 312-4, with a length of each sections 314-1, 314-2, 314-3 of the drill string 306 being equal to a distance between the sensing instruments 312-1, 312-2, 312-3, 312-4. More particularly, in this embodiment, a first section 314-1 of the drill string 306 is shown to be located between the first and second sensing instruments 312-1 and 312-2, and the length of the first section 314-1 may be equal to the axial distance between the first and second sensing instruments 312-1 and 312-2. Similarly, a second section 314-2 of the drill string 306 may be located between the second and third sensing instruments 312-2 and 312-3, while a third section 314-6 of the drill string 306 may be located between the third and fourth sensing instruments 312-3 and 312-4.

As evidenced by the surface shading in FIG. 4, each of the sections 314-1, 314-2, 314-3 of the drill string 306 may twist as a result of rotation and differences in rotational velocities along lengths of each section 314-1, 314-2, 314-3 of the drill string 306. For instance, in the illustrated embodiment, the second section 314-2 of the drill string 306 may have the largest angle of twist (as evidenced by the surface shading lines being most offset from vertical), while the first section 314-1 of the drill string 306 may have the smallest angle of twist. Such twist differences may indicate that the second section 314-2 is associated with the largest difference in rotational velocities (i.e., as measured between second and third sensing instruments 312-2, 312-3), while the first section 314-1 has the least difference in rotational velocities (i.e., as measured between first and second sensing instruments 312-1, 312-2). Indeed, in FIG. 4, the illustrated twist may indicate that third sensing instrument 312-3 may have the largest rotational velocity, followed, in decreasing order, by the fourth sensing instrument 312-4, the second sensing instrument 312-2, and the first sensing instrument 312-1.

When portions of the drill string 306 rotate at different velocities, each such portion of the drill string 306 may experience a different amount of torque. Such a torque may be useful in a number of applications. For instance, if the wellbore 302 has a reduced width, it may restrict movement of the drill string 306 at such location of reduced width.

Added friction may be located around the drill string 306, which can slow rotation of the drill string 306 at that location. By measuring the torque, locations of wellbore restrictions may be identified. Similarly, a drive shaft, motor, turbine, bit, reamer, stabilizer, or the like may have torque limitations, or a torque range where optimal efficiency or performance is obtained. By determining the torque at the locations of such components, a drilling system may determine whether or not to increase or decrease torque to obtain desired performance or tool life.

In some embodiments, torque may be measured using a strain gauge, positional sensor, or other tool. For instance, at least some, and potentially each, of the sensing instruments 312-1, 312-2, 312-3, 312-4 may include a strain gauge or other tool to directly measure torque, incremental torque, or the like. In other embodiments, the sensing instruments 312-1, 312-2, 312-3, 312-4 may include a positional sensor in addition to, or instead of, a strain gauge or other tool for directly measuring torque. Such a sensor may identify the relative differences in angular position to allow calculation of the angle of twist, and torque from the angle of twist.

For instance, torque on a rotating shaft or tube may be related to the angle of twist, the length of the rotating shaft or tube, and the material properties of the tube or shaft. For instance, in one embodiment, torque ("I") may be calculated using the following equation:

$$T = \frac{\Phi GJ}{L}$$

where $\phi$ represents the angle of twist, L represents the length of a rotating shaft or tube, G represents the material shear modulus for the shaft or tube, and J represents the polar moment of inertia. If rotational or angular positions at two locations (i.e., positions "A" and "B") are known, that angle of twist, and consequently the equation for torque, may be framed as:

$$\Phi = (P_A - P_B)$$

$$T = \frac{(P_A - P_B)GJ}{L_{AB}}$$

where $P_A$ is the angular position at point "A", $P_B$ is the angular position at point "B", and $L_{AB}$ is the length of the rotating shaft or tube between points A and B.

Calculating torque using angular position may be relatively straight forward, provided the drill string 306 includes positional sensors that measure angular position, and are synchronized to obtain relative positional readings at precisely the same moment. If, however, the drill string 306 does not include, or is not coupled to, angular position sensors, such a calculation may be more difficult.

In an alternative embodiment of the present disclosure, the sensing instruments 312-1, 312-2, 312-3, 312-4 may provide rotational velocity information as discussed herein. In the context of a rotating drill string 306, velocity at a particular time be expressed as the derivative of position, as shown below:

$$V = \frac{dP}{dt}$$

where "V" is a rotational velocity at a particular time ("t"), and "P" is a position. When a sensing instrument measures or otherwise obtains the rotational velocity ("V") value at a particular time ("t"), the position ("P") may then be obtained by integrating velocity. Thus, for each of two positions (i.e., positions "A" and "B") on a rotating shaft or tube, the positions may be expressed as:

$$P_A = \int V_A dt$$

$$P_B = \int V_B dt$$

In the above formulas, $V_A$ and $V_B$ may represent the instantaneous velocities at positions $P_A$ and $P_B$, respectively. As a result, by using the above equations, the angle of twist and instantaneous torque may be represented using the following equations:

$$\Phi = \left(\int V_A dt - \int V_B dt\right)$$

$$T = \frac{\left(\int V_A dt - \int V_B dt\right)GJ}{L_{AB}}$$

As illustrated by the above discussion and equations, where two or more of the sensing instruments 312-1, 312-2, 312-3, 312-4 measure or are otherwise used to determine rotational velocity, the torque on a section of the drill string 306 located between corresponding sensing instruments 312-1, 312-2, 312-3, 312-4 may be calculated, provided the length between sensing instruments sensing instruments 312-1, 312-2, 312-3, 312-4, and other physical properties are known.

To calculate the torque, the drill string 306 may itself include processing or other components that identify the rotational velocity as measured by sensing instruments 312-1, 312-2, 312-3, 312-4, and perform the desired calculations. For instance, in FIGS. 3 and 4, each of three sensing instruments 312-1, 312-2, 312-3 is shown as being located on a collar 330. The collar 330 may be coupled to the drill string 306, and may also include processing components to acquire rotational velocity information obtained from the sensing instruments 312-1, 312-2, 312-3, 312-4, receive or send information to another component (e.g., another collar 330), synchronize the sensing instruments sensing instruments 312-1, 312-2, 312-3, 312-4, or interpret the rotational velocity information and calculate or otherwise determine a torque on a respective section of the drill string 306.

Figure 6:
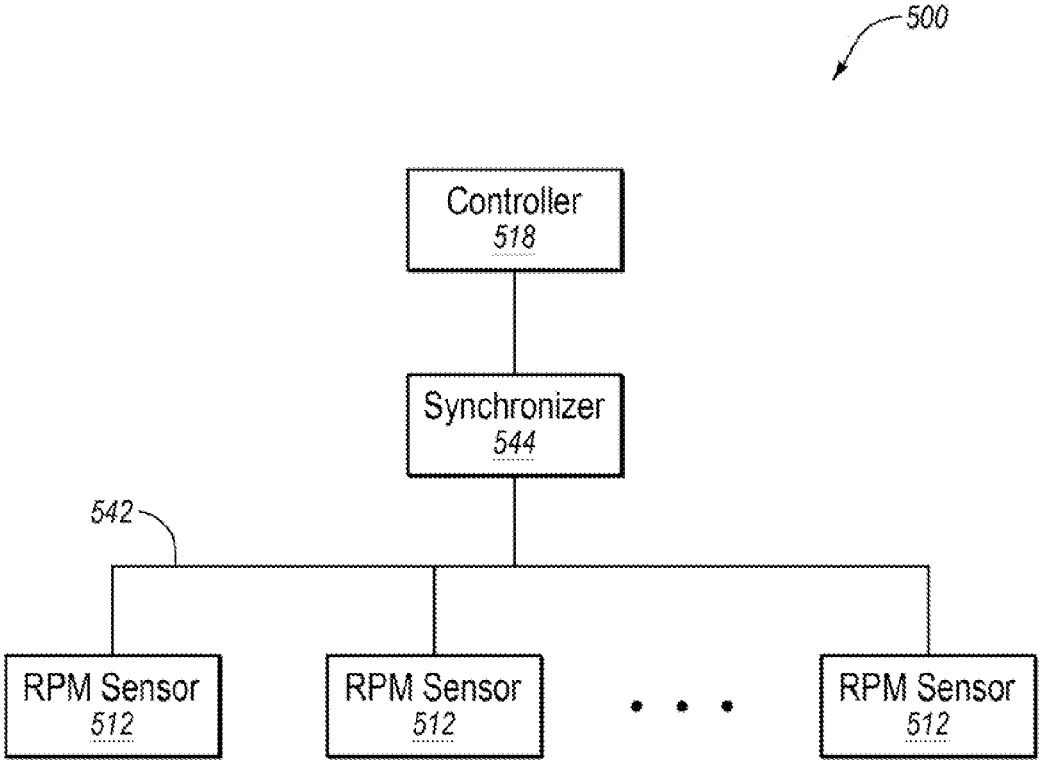
FIG. 6 schematically illustrates a system for measuring torque on one or more drill string components, according to another embodiment of the present disclosure.

FIG. 6 illustrates one example system 500 that may be used in connection with a drill string or other downhole component to determine torque or other properties of a downhole component. The system 500 is shown as including a controller 518, which may include or act as a processor. The controller 518 may use one or more communication paths 542 used to communicate with any number of sensors 512. The communication paths 542 may include wired (e.g., copper wire, fiber optics, etc.) or wireless (e.g., mud pulse telemetry, over-the-air, etc.) or other connections. As discussed herein, the sensors 512 may include sensors used to measure angular velocity in terms of rotations per minute, radians per second, or in any other desired units. Further, the sensors 512 may be located within a wellbore and coupled to a drill string, motor, drill bit, turbine, reamer, stabilizer, or other downhole component. Optionally, each sensor 512 includes or is coupled to its own processor, or other components, and may thus act as a so-called "smart sensor".

In one embodiment, a sensor 512 may collect information about the rotational velocity at a given position, and send the collected information through the communication lines 542 to the controller 518. The controller 518 may, in turn, collect the information from each of the sensors 512. The controller 518 may further process the information by, for instance, calculating torque and/or angle of twist at one or more locations. Such information may then be communicated to the surface for use or potentially additional processing.

Accordingly, in one embodiment, the controller 518 may be located downhole, and be communicatively linked to the surface. In another embodiment, however, the controller 518 may be at the surface. In such an embodiment, each sensor 312 may communicate information to the controller 518 at the surface for further processing or use. In still another embodiment, a processor associated with one or more of the sensors 312 may perform the processing such that a separate controller 518 may be omitted.

As also shown in FIG. 6, one embodiment of the present disclosure contemplates using a synchronizer 544 in communication with the controller 518 and/or the sensors 512. The synchronizer 544 may be used to provide synchronization across the sensors 512 to synchronize when data is obtained by the sensors 512. Thus, the synchronizer 5442 may be used to ensure that samples of rotational velocity and/or other information obtained by the sensors 512 are timed to occur at the same time, or nearly the same time.

The various components of the system 500 may take any of a number of suitable forms. For instance, the synchronizer 544 may be separate relative to the sensors 512 and/or controller 518, or may be integrated therewith. In one embodiment, the synchronizer 544 includes a direct electrical connection, a real time clock, an event trigger, or other component to synchronize sampling by the sensors 512.

The sensors 512 themselves may also have a number of capabilities and components. As discussed herein, the sensors 512 may be smart sensors that include processing capabilities, or may be communicatively linked to other components (e.g., controller 518). The synchronizer 544 may also be included wholly or partially in a sensor 512. In some embodiments, the sensors 512 may be enabled to obtain one or more different types of measurements or information. For instance, as discussed herein, a sensor 512 may include instruments for measuring the rotational velocity of a downhole component such as a drill string. In other embodiments, the sensors 512 may obtain other or additional information, including torque or angular position information. In one embodiment, the sensors 512 may obtain information such as depth within a wellbore. By using depth information, the length between two sensors 512 may be calculated. In other embodiments, however, a length between sensors 512 may be predetermined and known.

The sensors 512 are each optionally configured to obtain desired information with a desired precision and sampling rate. In one embodiment, a sensor 512 may be used in connection with a downhole component rotating at a relatively high speed. Consequently, the sampling rate of the sensors 512 may also be high to detect small phase shifts. In some embodiments, for instance, it may be desirable to have a half degree of resolution with respect to the angle of twist (i.e., 720 measurable positions over a full 360° revolution). If a drilling component is rotating at 300 revolutions per minute, the sampling rate may be about 3,600 Hz (i.e. 720*300/60). In contrast, if the rotation is increased to 2,500 revolutions per minute, as may be the case in an example turbine driven drilling component, the sensors may have a sampling rate of about 30 kHz (i.e., 2500*2500/60).

The above examples are merely illustrative. For instance, if the resolution is over less than half a degree, then sampling rate may be further increased, whereas a lower resolution may use a lower sampling rate. If the rotational speed is increased or decreased, the sampling rate may correspondingly increase or decrease. Illustratively, for an angle of twist resolution of about a quarter degree (i.e., 1440 positions over a full 360° revolution), a sensor on a shaft rotating at 300 revolutions per minute may have a sampling rate of about 7,200 Hz (i.e., 1440*300/60). A sensor on a turbine-driven drilling component, or other component rotating at about 2,500 revolutions per minute, could have a sampling rate of about 60 kHz (i.e., 1440*2500/60). In a corresponding manner, a decrease in desired resolution for the angle of twist may decrease the sampling frequency. For a resolution of one degree, a sensor on a shaft rotating at 300 revolutions per minute may have a sampling frequency of about 1,800 Hz (i.e., 360*300/60), whereas a sensor on a shaft rotating at 2,500 revolutions per minute may have a sampling rate of about 15 kHz (i.e., 360*2500/60). Of course, if the rotational speed of the downhole component is decreased, the sampling rate may also be decreased. For instance, for a resolution of one degree, a sensor on a shaft rotating at 100 revolutions per minute may have a sampling frequency of about 600 Hz (i.e., 360*100/60).

The sensors 512 may therefore have sampling rates that can be selected from a wide range of sampling rates, and which is configurable based on the anticipated rotational speed of a drilling component, desired resolution of the sensor, and the like. Sampling rates in various embodiments may therefore be up to about 60 kHz, up to about 30 kHz, up to about 15 kHz, up to about 7,200 Hz, up to about 3,600 Hz, up to about 1,800 Hz, or up to about 600 Hz in various embodiments, or anywhere therebetween. Of course, in other embodiments, the sampling rate for a sensor 512 may be less than about 600 Hz, or even greater than 60 kHz.

Each sensor 512 may be equipped to process, communicate, or store information in a number of manners. In one embodiment, for instance, a wired or wireless connection (e.g., communication line 542) may be used to allow sensors 512 to communicate with each other, a synchronizer 544, a controller 518, or some other component, or some combination thereof. Each sensor 512 may therefore also include a transmitter and/or receiver of some sort to allow communication.

In a particular embodiment, and as discussed herein, sensors 512 may be used in connection with a drill string to communicate information from a downhole location to the surface. In some embodiments, there may be a delay in transmission of the signal (e.g., in the case of mud pulse telemetry). In other embodiments the transmission may occur in about real time. In accordance with some embodiments, such communication may occur through the drill string. As an example, a drill string may be comprised of wired drill pipe components that can couple together and form a communication link to allow downhole information to be communicated to the surface. Alternatively coiled tubing may be coupled to a bottom-hole assembly and may include fiber optics, communication wires, or other components to allow near real-time communication with sensors in the bottom-hole assembly.

Figure 7:
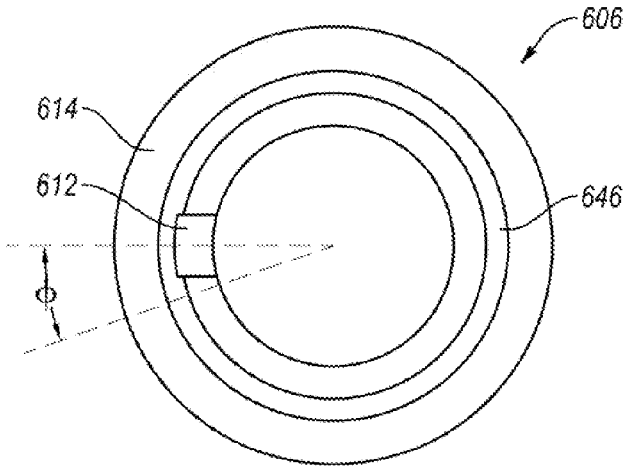
FIG. 7 is a top view of example wired drill pipe which has a torque applied thereto, according to another example embodiment of the present disclosure.

FIG. 7, for instance, illustrates a top view of a drill string 606 that includes a wired drill pipe component 614. In this particular embodiment, a sensing instrument 612 may be located on or within the wired drill pipe component 614. The sensing instrument 612 may obtain any of a number of different types of information, including information such as rotational velocity as discussed herein. For instance, the drill string 606 may include two or more sensing instruments 612. Two sensing instruments 612 may be separated by a length of the wired drill pipe component 614. As rotation of the wired drill string pipe 614 occurs, the angular position of the sensing instruments 612 may change, and may drift apart. In FIG. 7, for instance, two sensing instruments 613 may be angularly offset by an angle $\phi$, which may also be an angle of twist. Such information, whether measured directly, by integrating angular velocity, or in other manners, may then be used to calculate torque on the wired drill pipe component 414, and potentially the mechanical power transmitted through the wired drill string component 414.

Regardless of the particular types of information obtained by the sensing instrument 612, the sensing instrument 612 may be communicatively coupled to a conductive portion 646 of the wired drill pipe component 614, which acts as a communication element. The conductive portion 646 may be configured to provide an electrically conductive coupling between multiple wired drill pipe components 614. Thus, information obtained by one wired drill pipe component 614, may be passed to an adjacent wired drill pipe component 614 that is electronically or communicatively coupled via the conductive portion 646. In FIG. 7, the conductive portion 646 may be generally cylindrical and extend through potentially the full length of the wired drill pipe component 614; however, in other embodiments the length, shape, or other configuration of the conductive portion 646 may be varied. In any such embodiment, a series of wired drill pipe components 614 may be couple to one or more sensing instruments 612, and collectively convey information measured, processed, or otherwise determined by sensing instruments 612 to the surface.

One optional embodiment of the present disclosure may include the use of repeaters with wired drill pipe components 614. In general, a repeater may include one or more signal conditioning or amplification devices, and may be positioned at selected positions along the drill string 606. Such repeaters may be used to ensure adequate signal amplitude to convey a signal to the surface from the devices at a lower end of the drill string 606. Optionally, the sensing instrument 612 may also be used as a repeater to condition or amplify a signal sent along the conductive portion 646. In other embodiments, a repeater may be separate from a sensing instrument 612.

Figure 8:
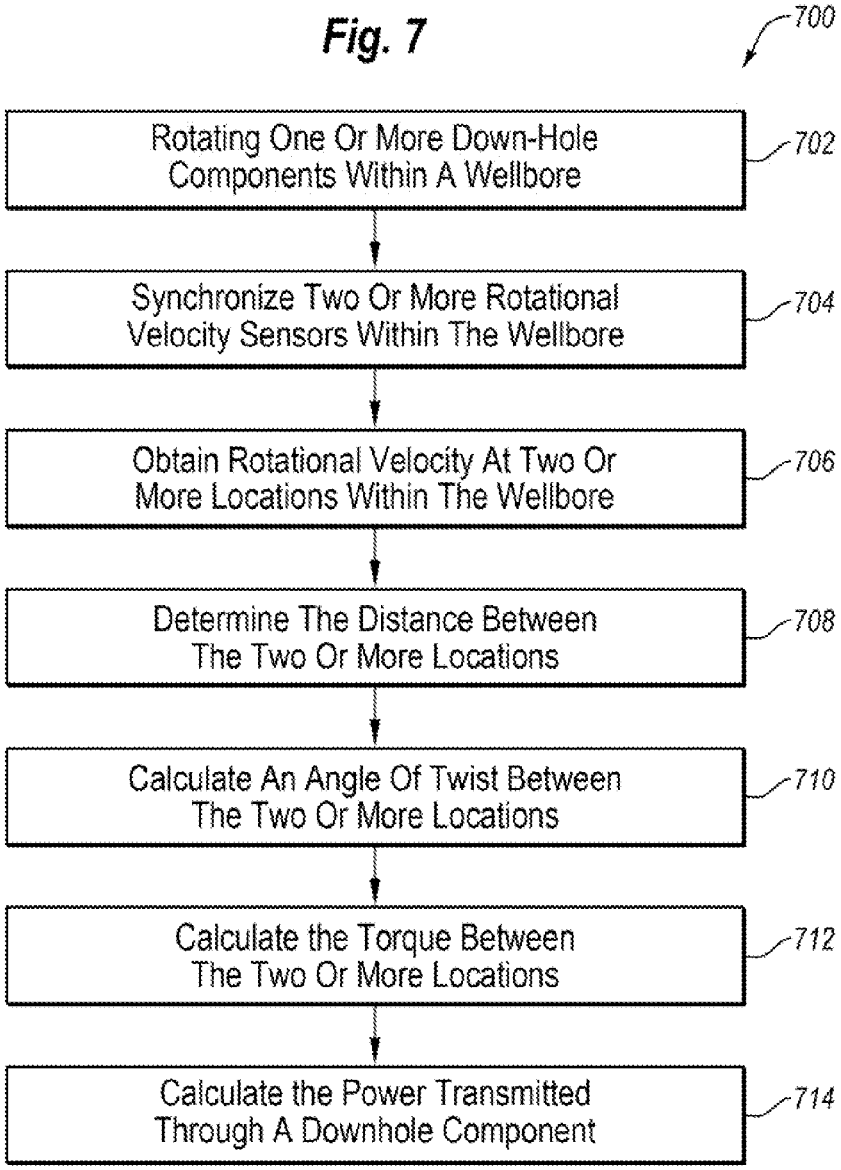
FIG. 8 illustrates an example method for measuring torque and/or angle of twist on a drill string component, according to one embodiment of the present disclosure.

As discussed herein, embodiments of the present disclosure relate to methods, systems, devices, and assemblies for determining properties in a downhole environment. Turning now to FIG. 8, an example flow chart is presented of a particular method 700 for determining properties of one or more downhole components. More particularly, the illustrated embodiment contemplates determining information such as an angle of twist, torque, or power transmission.

In the method 700 for determining properties of one or more downhole components, the method may include rotating one or more downhole components within a wellbore (702). Such a method may include, for instance, inserting a drill string into a wellbore and rotating the drill string. In the same or other embodiments, different components included on, or coupled to, the drill string may be rotated independently of the drill string itself. For instance, a mud motor, turbine, or other type of motor may be included to selectively rotate a drill bit, reamer, turbodrill, milling bit, or other downhole component, even potentially in the absence of rotation of the drill string. In such an embodiment, a drive shaft, drill bit, mill, bottom-hole assembly, or the like, may be the downhole component for which properties may be measured.

As further shown in FIG. 8, two or more rotational velocity sensors may optionally be synchronized within the wellbore (704). Synchronizing the rotational velocity sensors may include using a synchronizer, communication line, or other component to synchronize the timing at which the rotational velocity sensors obtain measurements of rotational velocity at particular locations. Two or more rotational velocity sensors, including those that are optionally synchronized, may also be used to obtain respective rotational velocities at two or more locations within the wellbore (706). Obtaining the respective rotational velocities at 706 may include, for instance, using an RPM sensor to determine the rate of rotation, in rotations per minute, at a particular location. Alternatively, the rotational velocity may be determined using sensors that obtain measurements in terms of radians per second, rotations per second, or in other units. Obtaining the rotational velocities at 706 may also include converting between units. Obtaining the rotational velocities at 706 may also include obtaining multiple measurements of rotational velocity at each location over a period of time.

When rotational velocities are obtained at two or more locations, there may be a distance, or length of a downhole component, extending between the two locations. Some embodiments of the present disclosure contemplate determining the distance between the two or more locations where rotational velocity is sampled (708). In one embodiment, for instance, depth sensors may be used to determine the depth at one location within a wellbore, and compare that depth with a depth at a second sensor. In another embodiment, however, the distance may be a predetermined distance. For instance, when a downhole component is inserted into a wellbore, the locations of rotational velocity sensors may be known, as may the distance between the locations. Determining the distance between the locations at 708 may therefore include identifying a predetermined distance.

The particular length between measurements may vary as desired. For instance, the length between measurements may be sufficiently long to allow determining of a resolvable difference between rotational speeds. Such a distance may vary based on the stiffness and other physical properties of a downhole component. As an example, a longer distance may be used for relatively stiff components as compared to relatively flexible components. In some embodiments, the length may therefore be relatively short, while in other embodiments the distance may be long. As an example, a length between measurements of rotational speed may be up to about 100 feet (30.5 m), up to about 60 feet (18.3 m), up to about 40 feet (12.2 m), or up to about 15 feet (4.6 m) in some embodiments. In a more particular embodiment, the length may be between about 10 feet (3.0 m) and about 50 feet (15.2 m). Of course, in other embodiments, the distance between measurements may be less than about ten feet (3.0 m) or more than about one hundred feet (12.2 m).

The particular length over which torque, mechanical power, or an angle of twist is determined may vary on other factors other than flexibility and stiffness as well. For instance, a system may be used to calculate torque on a bit, reamer, stabilizer, drive shaft, motor, or the like (see FIGS. 3 and 4 which include a sensing instrument 312-4 on or near the drill bit 310). Different downhole components may have different lengths. To determine the torque on a single component, rotational velocities may be measured at or near the ends of that component. The length of the component may then determine the distance between measurements. Of course, sensing instruments (e.g., sensors 312-1, 312-2, 312-3, 312-4) may also be placed on different downhole components to measure torque across multiple downhole components. Three or more sensing instruments may also be located on the same downhole component to measure torque at multiple locations on the same downhole component. In one embodiment, torque may be measured along a length of an entire drill string.

Optionally, the angle of twist between two or more locations may be calculated. To the extent positions at two or more locations are known, the angle of twist may be calculated as the difference in angular position at the two or more locations. In other embodiments, such as the method 700 of FIG. 8, where at least two rotational velocities may be determined, calculating the angle of twist may include integrating the rotational velocities to obtain position information, and then subtracting the results to obtain the angle of twist.

A further property of a downhole component within a wellbore may include the torque applied to the downhole component. In FIG. 8, the method 700 may include calculating the torque on the drill string component located between two or more locations (712). The locations may correspond to locations where rotational velocity information was obtained.

If rotational velocity information is known at two locations, the instantaneous torque may generally be calculated using the following equation, as previously noted:

$$T = \frac{\left(\int V_A dt - \int V_B dt\right) GJ}{L_{AB}}$$

Accordingly, in such an embodiment, calculating the torque may include integrating rotational velocities at two locations. A difference between the rotational velocities may be used with other physical properties (e.g., the length of a component between where the rotational velocities were measured, the shear modulus of the material being rotated and twisted, and the polar moment of inertia) to obtain a torque value. Optionally, a value for the angle of twist found at 710 may be used at 712.

According to some embodiments, it may also be desired to determine the amount of power transmitted through a downhole component (714). In general, power may be expressed in the following equation:

$$\text{Power} = T \times V$$

where "Power" is the amount of mechanical power transmitted through a downhole component, "T" is the torque on the downhole component, and "V" is the rotational velocity of the downhole component. Thus, where rotational velocity of a downhole component is known, the torque may be computed and then used to also find power transmission.

Optionally, where multiple downhole components are used, the torque and power for some or even each downhole component may be used to determine the total power transmission, and potentially identify where power losses are occurring, or the extent of such power losses. Similarly, locations of relatively higher or lower torque may be identified. The method 700, or another method, may therefore be repeated with each downhole component, or portion thereof. For instance, with two downhole components, the rotational velocities at four locations (or potentially three locations if one location is an endpoint for each of the two downhole components) may be found. Such information may be used to determine the angle of twist of each of the two downhole components and/or length and other physical properties may be used to determine the torque and power associated with each downhole component. Optionally, a power loss may be computed by determining a difference in power transmitted through one downhole component relative to a prior downhole component.

The method 700 may also be performed in any number of environments or conditions. For instance, as discussed herein, a downhole component may be used in a land-based drilling system or a subsea drilling system. Additionally, downhole components of different types may exist in different systems. For instance, a steerable drilling system may include a rotary steerable bit. Drill strings may also include wired drill pipe, coiled tubing, or other drill string components. In another embodiment, segmented drill pipe may be used to convey downhole components. Regardless of the type of downhole components included, embodiments herein contemplate calculating the torque on, power transmitted through, or angle of twist of, such components based on the rotational velocities at two or more locations.

In another example, the time at which torque, power, or the like is determined may also be varied using the method 700 of FIG. 8. For instance, a drill string may be conveyed into a wellbore. One or more components of the drill string may be rotating, or may be stationary or torque free. In some embodiments, a rotating component may stop rotating or a torque may be removed. Determining properties of the downhole components may, in some embodiments, be obtained by obtaining measurements of rotational velocity from start-up of rotation or the application of a torque. Thus, measurements may be obtained soon, if not immediately, after restarting rotation in the wellbore, or the application of torque to a downhole component. In accordance with some embodiments, determining torque or power soon after recommencing rotation of a downhole component may provide increased accuracy or ease of identifying peak torque, or torque differentials.

Embodiments of the present disclosure also contemplate measuring torque, mechanical power, angle of twist, or both, while a drilling operation is being performed, or after drilling. For instance, a real-time analysis system may include sensing instruments or other equipment to determine the torque and/or power through a particular drill string component in about real-time. This may allow drilling parameters (e.g., power supplied, rotational speed, penetration rate, etc.) to be varied to optimize drilling performance while a wellbore is being drilled. In some embodiments, an automation component may analyze the information and automate changes based on the received downhole measurements or processed data. In another embodiment, analysis may be performed on stored data. For instance, analysis may be performed post-drilling to analyze the drilling process and identify any drilling problems or equipment failures during the drill run.

While embodiments herein have been described with primary reference to downhole tools and drilling rigs, such embodiments are provided solely to illustrate one environment in which aspects of the present disclosure may be used. In other embodiments, downhole measurement systems and other components discussed herein, or which would be appreciated in view of the disclosure herein, may be used in other applications, including in automotive, aquatic, aerospace, hydroelectric, or other industries.

In the description herein, various relational terms are provided to facilitate an understanding of various aspects of some embodiments of the present disclosure. Relational terms such as "bottom," "below," "top," "above," "back," "front," "left", "right", "rear", "forward", "up", "down", "horizontal", "vertical", "clockwise", "counterclockwise," "upper", "lower", and the like, may be used to describe various components, including their operation and/or illustrated position relative to one or more other components. Relational terms do not indicate a particular orientation for each embodiment within the scope of the description or claims. For example, a component coupled to a drill string and "below" another component coupled to the drill string may be further downhole while within a vertical wellbore, but may have a different orientation during assembly, when removed from the wellbore, or in a deviated borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Relational terms may also be used to differentiate between similar components; however, descriptions may also refer to certain components or elements using designations such as "first," "second," "third," and the like. Such language is also provided merely for differentiation purposes, and is not intended limit a component to a singular designation. As such, a component referenced in the specification as the "first" component may or may not be the same component that may be referenced in the claims as a "first" component.

Furthermore, to the extent the description or claims refer to "an additional" or "other" element, feature, aspect, component, or the like, it does not preclude there being a single element, or more than one, of the additional element. Where the claims or description refer to "a" or "an" element, such reference is not be construed that there is just one of that element, but is instead to be inclusive of other components and understood as "one or more" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," "integral with," or "in connection with via one or more intermediate elements or members."

Although various example embodiments have been described in detail herein, those skilled in the art will readily appreciate in view of the present disclosure that many modifications are possible in the example embodiment without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination. In addition, other embodiments of the present disclosure may also be devised which lie within the scopes of the disclosure and the appended claims. Each addition, deletion, and modification to the embodiments that falls within the meaning and scope of the claims is to be embraced by the claims.

In the claims, means-plus-function clauses are intended to cover the structures described herein as performing the recited function, including both structural equivalents and equivalent structures. Thus, although a nail and a screw may not be structural equivalents in that a nail employs a cylindrical surface to couple wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

Certain embodiments and features may have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges may appear in one or more claims below. Any numerical value is "about" or "approximately" the indicated value, and take into account experimental error and variations that would be expected by a person having ordinary skill in the art.

What is claimed is:

1. A method for determining torque on a downhole component within a wellbore, comprising:

obtaining a first rotational velocity measurement at a first location of a downhole component;

obtaining a second rotational velocity measurement at a second location of the downhole component, wherein obtaining the first and second rotational velocity measurements includes synchronizing sampling of the first and second rotational velocity measurements; and calculating torque on the downhole component using the first and second rotational velocity measurements.

2. The method recited in claim 1, wherein calculating torque on the downhole component includes:

integrating the first and second rotational velocity measurements.

3. The method recited in claim 1, wherein calculating torque on the downhole component includes:

calculating an angle of twist of the downhole component.

4. The method recited in claim 3, further comprising:

calculating a difference between an integral of the first rotational velocity measurement and an integral of the second rotational velocity measurement.

5. The method recited in claim 1, wherein calculating torque on the downhole component includes calculating torque upon start-up of rotation of the downhole component.

6. The method recited in claim 1, further comprising:

calculating mechanical power transmitted through the downhole component.

7. The method recited in claim 1, wherein calculating torque includes determining a length between the first and second locations of the downhole component.

8. The method recited in claim 7, wherein the length is a predetermined length.

9. The method recited in claim 1, wherein calculating torque includes calculating torque using the equation:

$$T = \frac{\left(\int V_A dt - \int V_B dt\right) GJ}{L_{AB}}$$

where T is the torque, $V_A$ is a rotational velocity at the first location, $V_B$ is a rotational velocity at the second location, $L_{AB}$ is a length between the first and second locations, G is a material shear modulus, and J is a polar moment of inertia.

10. The method recited in claim 1, wherein calculating torque on the downhole component includes receiving the first and second rotational velocity measurements at a surface of the wellbore and thereafter calculating torque.

11. A drilling system, comprising:

a downhole component;

at least two sensing instruments coupled to the downhole component, each of the at least two sensing instruments including a rotational velocity sensor;

a controller communicatively coupled to the at least two sensing instruments, the controller being programmed to use rotational velocity measurements from the rotational velocity sensors to calculate a torque on at least a portion of the downhole component located adjacent one or both of the at least two sensing instruments; and a synchronizer configured to synchronize sampling of rotational velocity measurements by the rotational velocity sensors.

12. The drilling system recited in claim 11, the controller being programmed to calculate the torque on a portion of the downhole component located between the at least two sensing instruments.

13. The drilling system recited in claim 11, the controller being programmed to integrate rotational velocity measurements to obtain angular position information.

14. The drilling system recited in claim 11, the controller being coupled to the drill string.

15. The drilling system recited in claim 11, the downhole component including one or more of:

a drill string;

a bottom-hole assembly;

a motor;

a drill bit;

a milling bit;

a reamer; or a stabilizer.

16. The drilling system recited in claim 11, the drill string including wired drill pipe, the at least two sensing instruments being in communication with a conductive communication element of the wired drill pipe.

17. The drilling system recited in claim 11, the synchronizer using a sampling rate selected based on at least a rotational speed and an angle of twist resolution.

18. A method for calculating torque on a downhole tool within a wellbore, comprising:

obtaining synchronized measurements of rotational velocity at first and second locations of a downhole tool within a wellbore;

integrating the synchronized measurements of rotational velocity at the first and second locations;

determining a difference between the integrals of synchronized measurements of rotational velocity at the first and second locations; and calculating a torque between the first and second locations using the difference between the integrals, a distance between the first and second locations, and physical properties of the downhole tool.

19. The method recited in claim 18, wherein obtaining synchronized measurements includes obtaining measurements using rotational velocity sensors operating at a sampling rate selected based on at least a rotational speed and an angle of twist resolution.

20. The method recited in claim 18, wherein the downhole tool includes or is coupled to a drill string, and wherein calculating the torque includes calculating torque using a controller:

coupled to a drill string; or at a surface of the wellbore.

* * * * *